United States Patent [19]

Verseef

[11] Patent Number: 4,837,951

[45] Date of Patent: Jun. 13, 1989

[54] REVERSIBLE MOLDBOARD ASSEMBLY

[75] Inventor: Jan H. Verseef, Clayton, N.Y.

[73] Assignee: Frink America, Inc., Clayton, N.Y.

[21] Appl. No.: 248,180

[22] Filed: Sep. 23, 1988

[51] Int. Cl.[4] ..... E01H 4/00; E01H 5/06

[52] U.S. Cl. ..... 37/197; 37/281

[58] Field of Search ..... 37/281, 274, 275, 216, 37/197, 233, 260, 266, 279, 284; 294/54.5, 55

[56] References Cited

U.S. PATENT DOCUMENTS

| | | | |
|---|---|---|---|
| 1,926,011 | 9/1933 | Soule | 37/275 |
| 2,160,972 | 6/1939 | Litchy | 37/275 |
| 3,466,767 | 9/1969 | Rubin | 37/260 |
| 3,808,714 | 5/1974 | Reissinger | 37/233 |
| 4,459,769 | 7/1984 | Willis, Sr. | 37/275 |
| 4,574,502 | 3/1986 | Blau | 37/266 |
| 4,651,451 | 3/1987 | Beeley | 37/281 |

*Primary Examiner*—Eugene H. Eickholt
*Attorney, Agent, or Firm*—Wall and Roehrig

[57] ABSTRACT

A moldboard assembly having a flexible moldboard sheet joined along its bottom edge to a scraper blade unit so that material passing over the blade is directed into contact with the sheet. Adjusting arms are secured to the top corners of the sheet and are independently positioned to contour the sheet to any desired shape whereby the flow of material through the assembly can be accurately controlled.

21 Claims, 6 Drawing Sheets

REVERSIBLE MOLDBOARD ASSEMBLY

BACKGROUND OF THE INVENTION

This invention relates to a moldboard assembly having a flexible moldboard sheet that is adjustable to change the contour of the moldboard to control the flow of material through the moldboard and the direction of discharge.

Most conventional moldboards are formed from metal into a desired shape depending upon its intended use. In some cases the moldboard is involuted to provide a flared discharge at one end for casting snow to one side or the other of the propelling vehicle. When it is necessary to discharge to the opposite side of the vehicle, however, the contoured moldboard assembly must be replaced with one flared at the opposite end. Changing a moldboard assembly is a time consuming and often difficult task that is made even more difficult because of the accumulation of ice and snow within the component parts of the plow. Typically the truck is "deadheaded" or returned to the garage when a conversion is necessary so that the plow can be worked on indoors.

A roll-over snow plow has been developed by the present assignee that permitted a moldboard, contoured for a right hand discharge, to be converted to a left hand discharge in a matter of seconds. The moldboard assembly in this piece of equipment has cutting edges running along the opposed lateral edges of the moldboard. A lifting mechanism is attached to the moldboard that lifts the moldboard, rotates it 180 degrees, and lowers it back into a plowing position when a conversion is needed. The operator does not have to leave the cab to make the changeover and no further adjustment to equipment is necessary. The rollover design has been found to be most useful in clearing large open areas such as parking lots and airport runways where wind is a factor or where the snow must be discharged into prescribed disposal areas.

The rollover plow requires additional equipment to carry out the conversion maneuver and therefore is heavier and relatively more expensive when compared to a more conventional plow.

Metal (steel) moldboards are heavy pieces of equipment and require a good deal of horsepower to propel. This, of course, results in higher fuel consumption. Snow also sticks or packs upon the working surface of the metal moldboard therein lowering the plow efficiency and again increasing fuel consumption. A lightweight plastic moldboard has been developed by the present assignee which, unlike a steel moldboard, does not have to be laboriously bent to a desired curvature during manufacture. The plastic moldboard is simply molded or otherwise formed into a sheet of desired dimensions and the sheet is then bolted upon a support frame. The plastic moldboard is not only lighter than its metal counterpart, but it also has a low coefficient of friction which prevents snow from sticking to its surface. The plastic moldboard has been proven to save up to thirty percent in fuel costs. However, once it is bolted to the frame, its shape cannot be altered.

SUMMARY OF THE INVENTION

It is therefore an object of the present invention to improve the efficiency of snow plows.

It is another object of this invention to provide a moldboard assembly for a snowplow, the contour of which can be selectively changed to control the flow of snow through the assembly.

It is a further object of the present invention to provide a snow plow that can be reversed to discharge snow from one side or the other by selectively changing the curved taper of the moldboard.

Another object of the present invention is to reduce the amount of equipment required to convert a moldboard from a left hand discharge configuration to a right hand discharge configuration.

These and other objects of the present invention are attained by securing the bottom edge of a flexible moldboard sheet to the top edge of a scraper blade unit, attaching an adjustable arm to each top corner of the sheet and independently positioning each of the arms to contour the sheet to a desired shape.

BRIEF DESCRIPTION OF THE DRAWINGS

For a better understanding of these and other objects of the present invention, reference shall be made to the following detailed description of the invention which is to be read in association with the accompanying drawings, wherein.

DETAILED DESCRIPTION OF THE INVENTION

Figure 1:
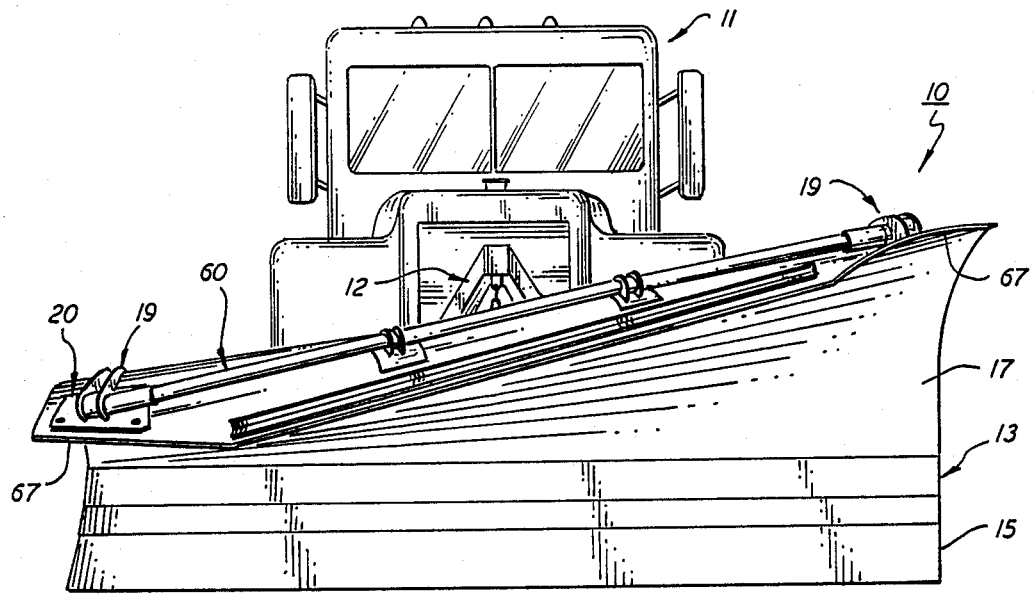
FIG. 1 is a front view of a moldboard assembly embodying the teachings of the present invention showing the moldboard contoured to discharge snow to the left side of a vehicle to which the moldboard assembly is attached.
Figure 2:
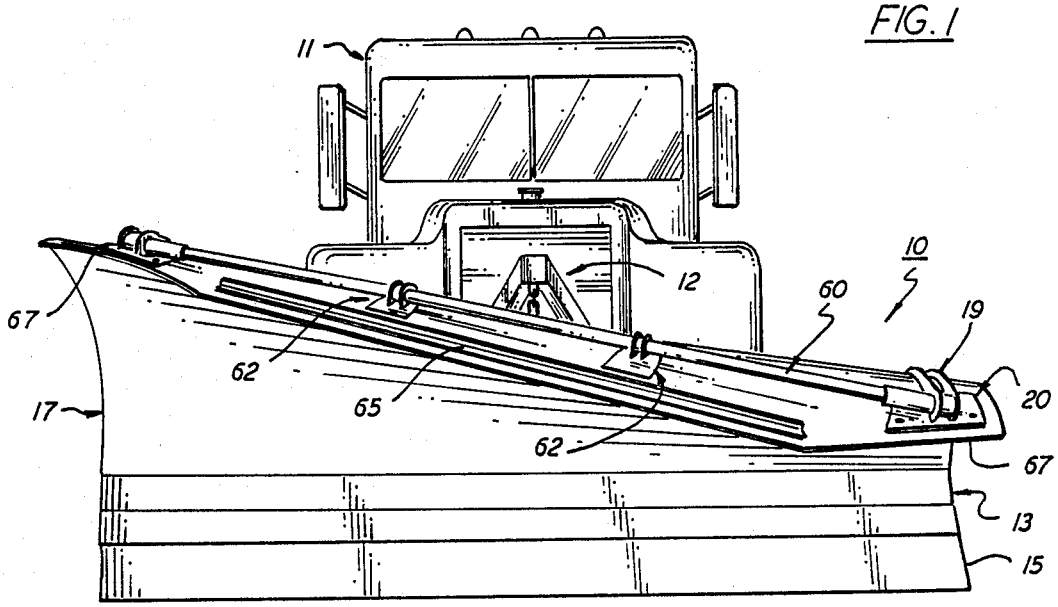
FIG. 2 is similar to that of FIG. 1 showing the moldboard contoured to discharge snow to the right side of the vehicle.
Figure 3:
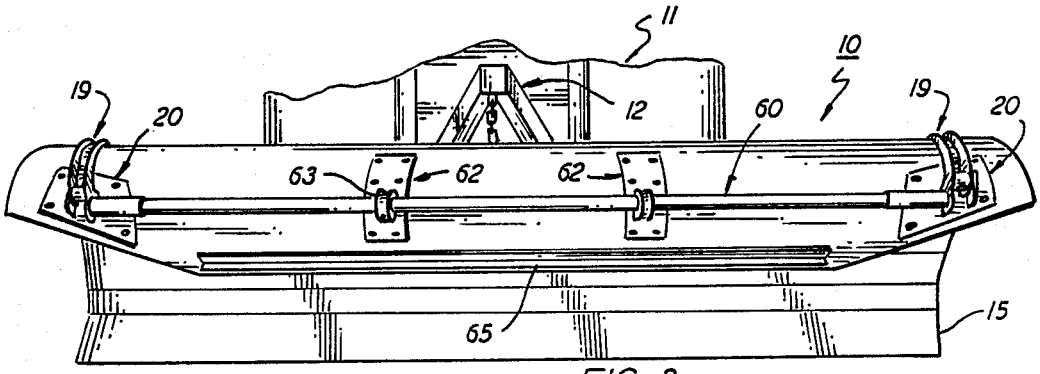
FIG. 3 is also similar to FIG. 1 showing the moldboard placed in a neutral position whereby the curvature across the moldboard is uniform.

Referring now to the drawings, and in particular to FIGS. 1-3, there is shown a moldboard assembly, generally referenced 10, that is attached to the front of a truck 11 by means of a combination push frame and lifting conventional adjusting arm mechanism 12 of any suitable design. The moldboard assembly includes a trip blade unit 13 containing an elongated scraper blade 15, a flexible moldboard sheet 17 and a pair of spaced apart adjusting arms 19—19 that are attached to the back of the moldboard sheet at the top corners by ball and socket connectors 20—20. As will be explained in greater detail below, the shape of the flexible moldboard sheet can be varied through the use of the adjusting arms to control the movement of snow through the moldboard and thus permits an operator to deliver snow to either side of a vehicle without dismounting from the cab. The flexible moldboard is particularly well suited for use in clearing airport runways, large parking lots, highways or any open area where it is oftentimes necessary to move snow to either side of a vehicle, depending on the location of the snow disposal area or prevailing wind conditions.

The flexible moldboard 17 is fabricated from a single sheet of any suitable high strength flexible material that is abrasion resistant and has high impact resistance. Preferably the moldboard sheet is constructed of any one of many plastics exhibiting these characteristics or blends thereof. Because snow will not stick to most plastics, the flow of snow through a plastic moldboard will be relatively constant for any configuration. The operator therefore can finely tune the moldboard much like an adjustable fluid nozzle to meet different snow conditions and/or to place the snow with refined accuracy into desired disposal area.

Figure 4:
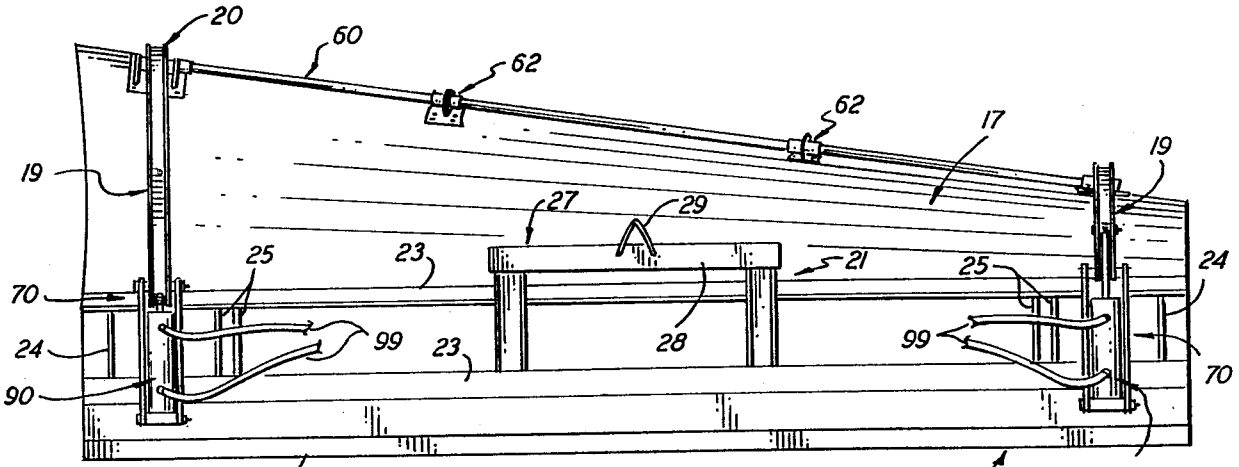
FIG. 4 is a rear elevation of the present moldboard assembly showing the support frame of the assembly.
Figure 5:
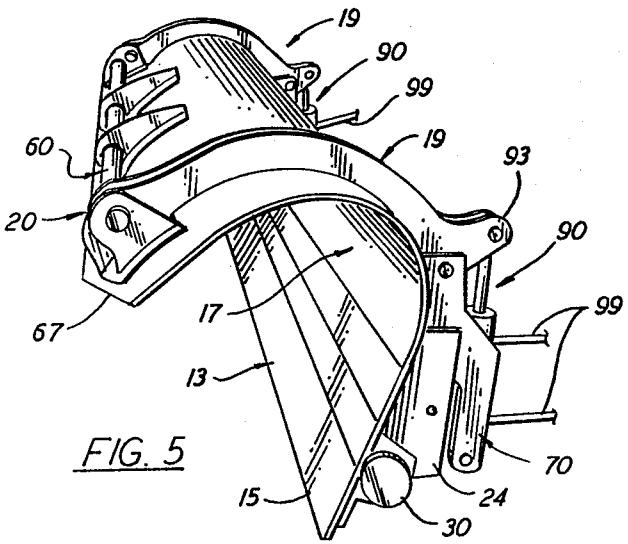
FIG. 5 is a perspective view showing the moldboard of the present invention.
Figure 6:
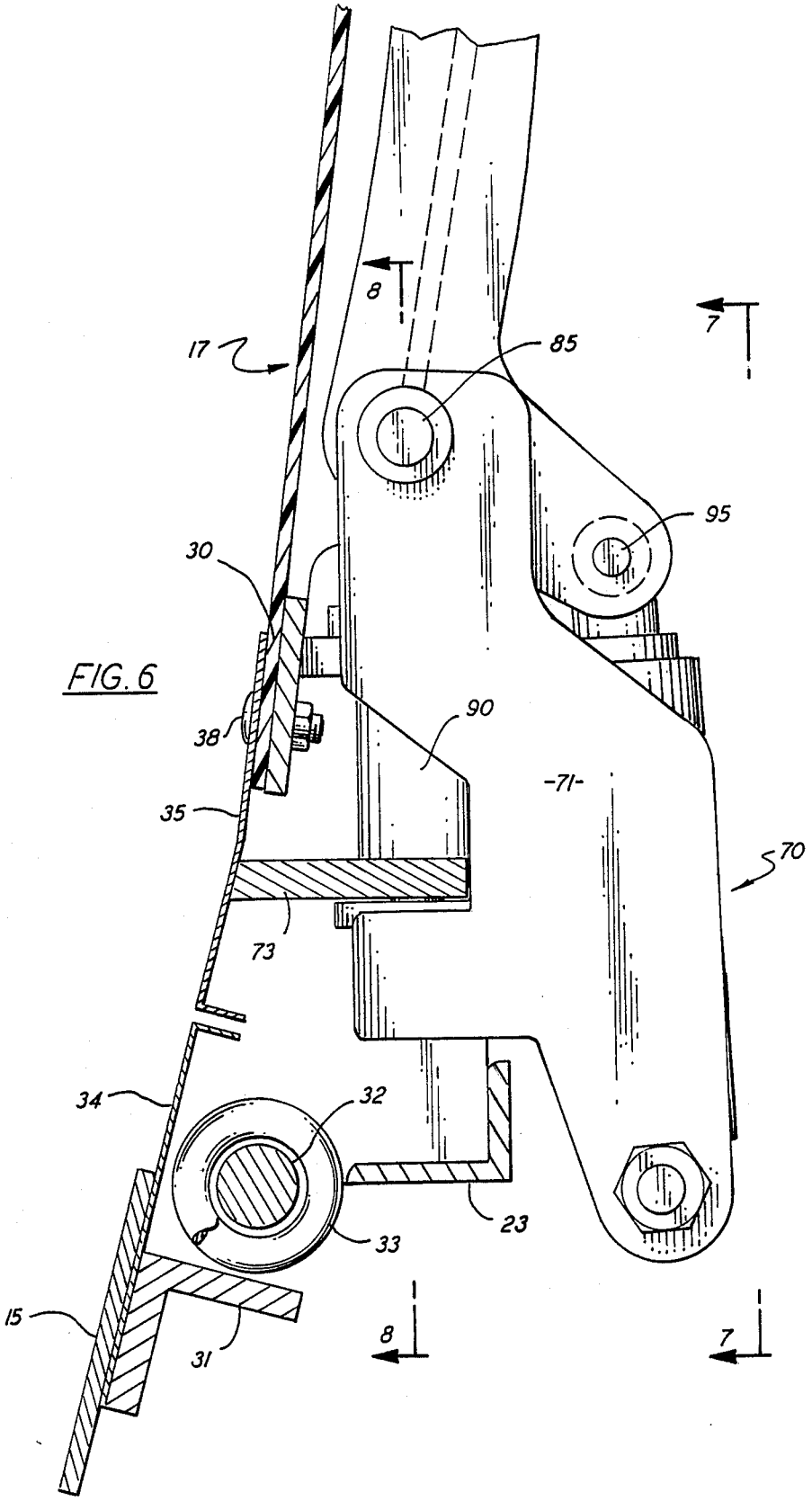
FIG. 6 is an enlarged partial side elevation showing the present moldboard assembly and one of the adjusting arms mounted in the support frame of the assembly.

As further illustrated in FIGS. 4–6, the moldboard assembly includes a rigid main support frame generally referenced 21 that is located behind the trip blade assembly and the previously noted flexible moldboard sheet. The frame contains a pair of spaced horizontal members 22 and 23 that are joined by means of vertical aligned end ribs 24—24 and interior ribs 25—25. A lifting bracket 27 is welded to the frame so that it is centrally located therein. The bracket has an upper horizontally disposed cross member 28 containing a link 29 for attaching the moldboard assembly to the pusher frame and lifting assembly mounted upon the front of the vehicle 12 (FIG. 1).

Figure 7:
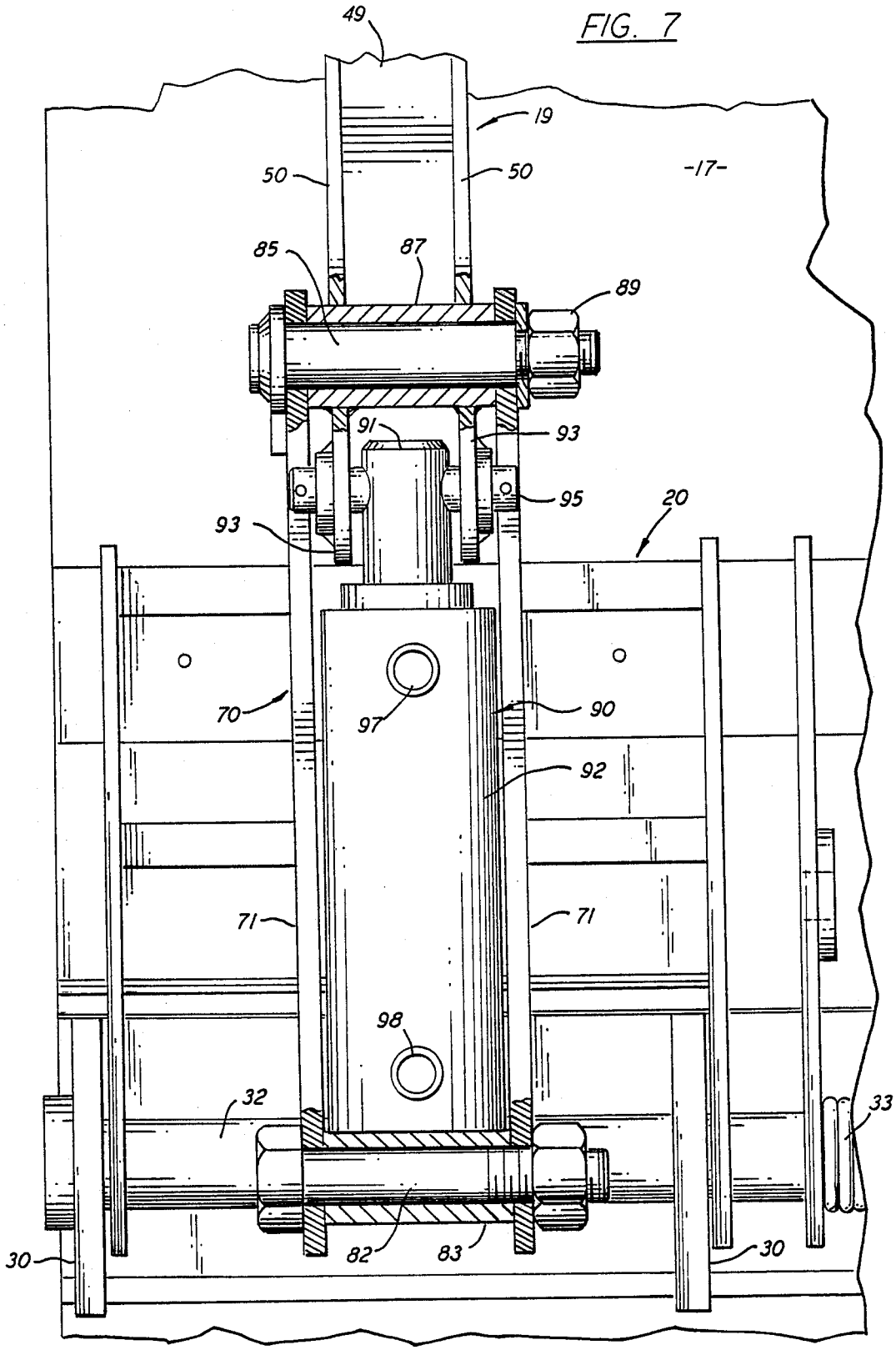
FIG. 7 is a partial sectional view taken along lines 7—7 in FIG. 6.
Figure 8:
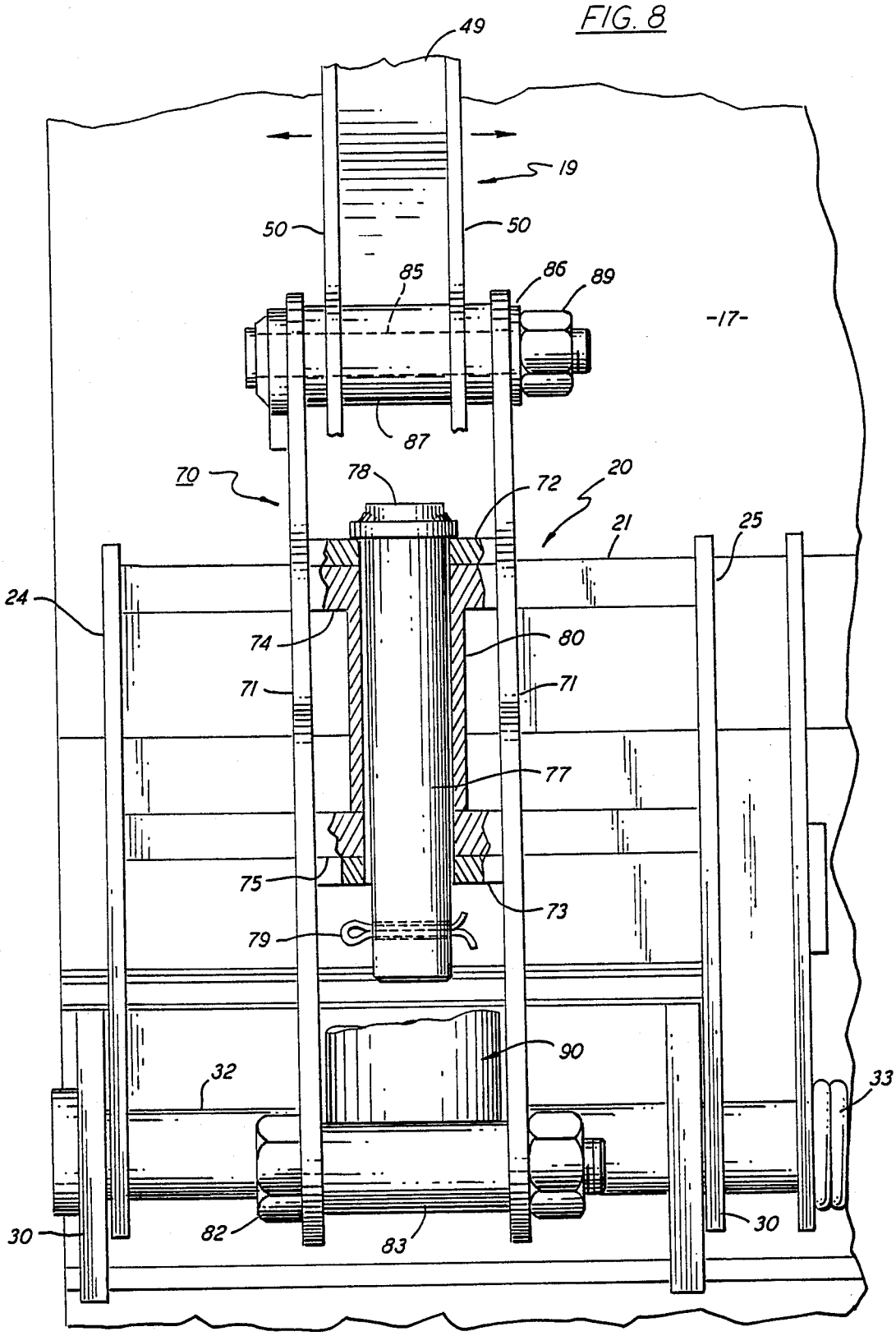
FIG. 8 is a view taken along lines 8—8 in FIG. 6.

As best illustrated in FIG. 6, the scraper blade 15 is secured to horizontally disposed angle 31 which is rotatably supported upon a series of coaxially aligned shafts 32. The shafts, in turn, are supported on the main support frame within mounting lugs 30—30 (FIGS. 7 and 8). A series of torsion springs 33 are wound about the shaft and are arranged to act against the angle to bias the scraper blade in the normal plowing position as shown. In the event the blade moves against a rigid obstruction as it is being driven forward by the truck, the blade will turn under the shaft to permit the object to move thereunder. Once the object has passed under the assembly, the springs will quickly return the blade to a normal operative position.

A deflector plate 34 is sandwiched between the blade 15 and angle 31. The plate extends upwardly beyond the top of the blade and is arranged to coact with a guide plate 35 to direct snow moving over the blade upwardly into contact with the flexible moldboard sheet 17. A backing member 37 is secured to upper frame member 22 as by welding and the upper section of the guide plate 35 is securely bolted along its length to the backing plate by means of uniformly spaced carriage bolts 38. The bottom skirt 39 of the flexible moldboard sheet is clamped between the guide plate 35 and the backing member 37 and is securely held in place by the bolts which are arranged to pass through holes provided in the sheet. The entire lower edge of the rectangular moldboard sheet is thus held immobile in the top of the trip blade unit. The upper part of the flexible sheet is free to move so that it can be selectively shaped to most efficiently handle snow for prevailing weather and road conditions.

Figures 9, 10:
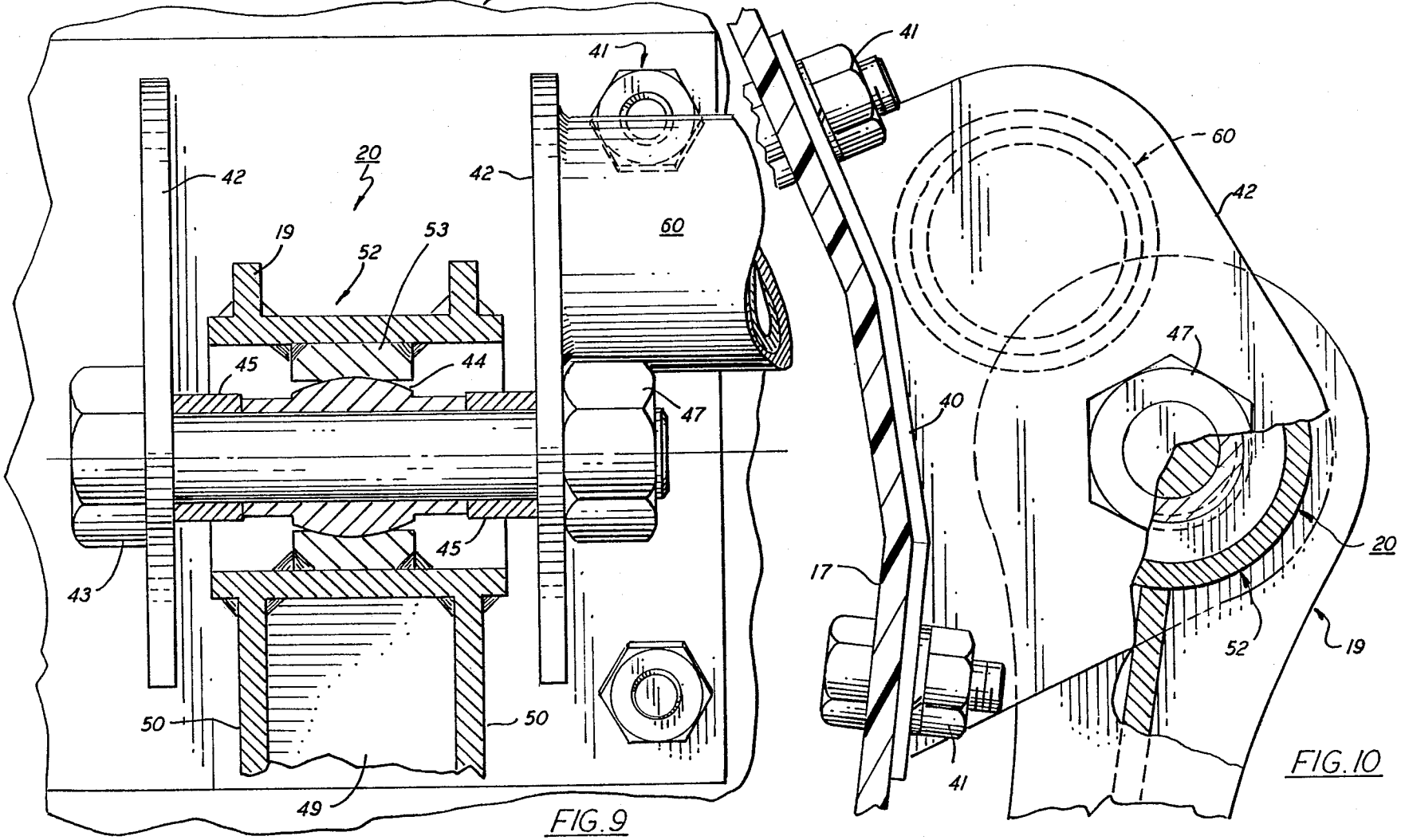
FIG. 9 is an enlarged plane view in partial section showing a universal joint for securing an actuator arm to the top corners of the moldboard sheet.
FIG. 10 is a side elevation of the universal joint shown in FIG. 9.

The upper section of the flexible moldboard sheet is connected at the two rear top corners to the distal ends of movable adjusting arms 19—19 by means of universal connectors 20—20. FIGS. 9 and 10 show in greater detail the construction of one of the connectors. A base plate 40 is bolted to the back of the sheet at the corner by bolts 41—41. A pair of raised parallel tabs 42—42 depend upwardly from the base plate and a bolt 43 is passed through the tabs and is secured in place by locknut 47. A cylindrical ball segment 44 is mounted on the stud portion of the bolt and is centered between the tabs by means of two centering bushings 45—45.

Each adjusting arm 19 includes having a web 49 and a pair of opposed side walls 50—50 (FIG. 9). A cylindrical sleeve 52 is passed through holes provided in the sidewalls 50—50 of the adjusting arm and is welded to the sidewalls as shown. A ball seat 53 is affixed to the inner wall of the tube and mates in assembly with the ball segment to provide a universal joint between the arm and the top corner of the sheet.

Figure 11:
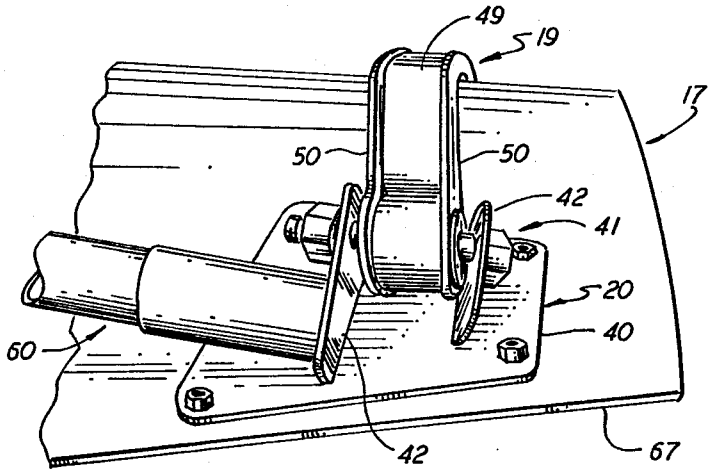
FIG. 11 is a perspective view of the universal joint shown in FIG. 9.

A cylindrical spacer bar 60 (FIG. 11) is welded at each end to the inside tab of each universal connector. As illustrated in FIGS. 1–3, the bar 60 is slidably retained within a pair of slide units 62—62 affixed to the upper back part of the sheet by any suitable means. Each slide unit includes a cylindrical bushing 63 that encompasses the bar and permits it to move freely along the back of the sheet. The bar serves to maintain a uniform spacing between the top corners of the sheet as the moldboard contour is being changed. As will become evident from the disclosure below, the adjusting arms are permitted to turn independently in separate vertical planes to roll the sheet forwardly over the top of the blade unit. By maintaining the spacing between the top corners constant, the front surface of the sheet which is presented to the snow will always be arcuate in form regardless of the adjusting arm positions.

As shown in FIG. 1 an elongated stiffening beam 65 is bolted on the back of the moldboard sheet along the top edge thereof which keeps the top edge of the sheet in parallel alignment with the spacer bar 60 at all times. Diagonal cut outs 67—67 are provided at each top corner of the sheet to prevent the corners form extending downwardly below the lower margins of the moldboard when the sheet is rolled forward into the two extreme positions shown in FIGS. 1 and 2.

Referring once again to FIGS. 6, 7 and 8, the proximal or lower end of each adjusting arm is contained within a movable bracket generally depicted at 70. The bracket includes a pair of vertical sidewalls 71—71 that are held in spaced relationship by a horizontal webs 72 and 73. The webs, in assembly, are superimposed over an upper horizontal flange 74 and a lower horizontal flange 75 which are securely welded to the main frame. A pivot pin 77 having an expanded head 78 is passed downwardly through the superimposed members and is retained in assembly by a cotter pin 79. A vertical tube 80 is mounted between the flanges which surrounds the body of the pivot pin 77. A tie bolt 82, which is arranged to pass through both horizontal sleeve 83 and the bottom section of the bracket, is bolted in place to hold the lower portion of the sidewalls in spaced apart alignment.

Accordingly, the bracket is secured to the main frame of the moldboard assembly by horizontal pivot pin 77 which permits the bracket to swing in a horizontal plane about the pin.

The proximal or lower end of each adjusting arm 19 passes between the upper sections of the bracket sidewalls and is secured therebetween by a threaded horizontally disposed hinge pin 85. A spacer sleeve 87 passes through the sidewalls 50—50 of arm 19 and seats against the opposing sidewalls of the bracket. The threaded end of the hinge pin is secured in place by means of a lock nut 89. Adjusting arm 19 is thus adapted to pivot in either a horizontal or a vertical plane. As will become apparent from the disclosure below, this freedom to move in two planes allows each adjusting arm to independently position one top corner of the moldboard sheet in an infinite number of positions within the movable range of the arm.

As shown in FIG. 7, a double acting hydraulic cylinder 90 is pivotally mounted in the lower part of each bracket 70 upon sleeve 83. A reciprocating rod 91 extends from the top of the cylinder body 92 and is connected between ears 93—93 carried in the lower part of the movable arm 19 by means of a horizontally disposed pin 95. By extending or retracting the rod 91, the arm can be turned about horizontal hinge pin 85 thus permitting the attached top corner of the moldboard sheet to be selectively positioned. A pair of ports 97 and 98 are provided in the cylinder body by which hydraulic hoses 99—99 (FIG. 4) are connected. Fluid is pumped from a reservoir to either side of a power piston (not shown) housed within the cylinder body. The activity of each power cylinder is controlled by the operator from the cab of the vehicle using suitable hydraulic controls (not shown). By simply extending and retracting the cylinder rods, the entire contour of the flexible moldboard can be selectively changed to direct snow form one side of the vehicle to the other. In addition, the shape of the moldboard can be finely adjusted or tuned to more efficiently handle snow under a wide range of conditions. Snow passing through the assembly will not adhere to the sheet so that once an adjustment is made, the flow path of the material will remain constant as long as the snow condition remains unchanged.

While this invention has been explained with reference to the structure disclosed herein, it is not confined to the details as set forth and this application is intended to cover any modifications and changes as may come within the scope of the following claims.

What is claimed is:

1. A moldboard assembly for use in a snowplow that includes an elongated scraper blade means, a rectangular flexible moldboard sheet attached along its bottom edge in the top of the scraper blade means, a pair of adjusting arms, each arm being connected at its distal end to one top corner of the moldboard sheet, and actuating means for independently positioning each of the adjusting arms whereby the moldboard sheet can be contoured to a desired shape.

2. The moldboard assembly of claim 1 that further includes a frame means, fixed support means for mounting the scraper blade means in the frame, and movable support means for mounting the proximal ends of the adjusting arms in the frame.

3. The moldboard assembly of claim 1 that further includes universal joint means for movably connecting the distal end of each adjusting arm to one top corner of the moldboard sheet.

4. The moldboard assembly of claim 1 that further includes a spacer bar that connects the distal ends of the adjusting arms.

5. The moldboard assembly of claim 4 that further includes means for slidably connecting the spacer bar to the top of the moldboard sheet in parallel alignment therewith.

6. The moldboard assembly of claim 2 that further includes a hinge means for connecting the proximal end of each adjusting arm to the frame.

7. The moldboard assembly of claim 6 wherein said actuator means includes a pair of power cylinders, each cylinder having an extendable rod and being arranged to act between an arm and the frame to move the arm in a vertical plane about the hinge means as the rod is extended and retracted.

8. The moldboard assembly of claim 7 that further includes a bracket for housing each power cylinder and a vertically disposed pivot pin for securing each bracket in the frame so that the bracket can turn about the pivot.

9. A moldboard assembly for use in a snowplow that includes a frame for attaching a moldboard to a vehicle, a scraper unit attached to the front of the frame that contains an elongated horizontally disposed scraper blade, a rectangular flexible moldboard sheet that is secured along its bottom edge to the scraper unit whereby the moldboard sheet extends laterally along the entire length of the scraper unit, a pair of spaced apart arcuate shaped adjusting arms vertically disposed from the frame behind the moldboard sheet, connecting means for attaching each adjusting arm to the back of the sheet at one top corner thereof, hinge means for pivotally securing the proximal end of each adjusting arm in the frame so that the arm is independently positionable in a vertical plane, and actuating means for independently positioning each of the adjusting arms to contour the moldboard into a desired shape.

10. The assembly of claim 9 that further includes an elongated stiffener attached to the sheet along its top edge.

11. The assembly of claim 9 wherein said actuating means further includes a power cylinder mounted between the proximal end of each adjusting arm and the frame, each power cylinder further including a reciprocating rod that can be extended and retracted to selectively position the attached adjusting arm.

12. The assembly of claim 9 that further includes a trip means for supporting the scraper blade in the scraper unit so that the blade will trip upon striking a rigid obstacle.

13. The assembly of claim 9 wherein the moldboard is fabricated from a single sheet of high strength plastic.

14. The assembly of claim 9 wherein each connecting means includes a ball and socket joint for attaching the distal end of an adjusting rod to the back top corner of the moldboard sheet.

15. The assembly of claim 14 that further includes a spacer bar attached to each connecting means and further means for slidably retaining the bar on the back side of the moldboard sheet.

16. The assembly of claim 15 that further includes a bracket for movably supporting each power cylinder in the frame.

17. The assembly of claim 16 wherein each cylinder rod is attached to an adjusting arm by a horizontally disposed hinge pin and each bracket is attached to the frame by a vertically disposed pivot pin whereby the arm can turn in both a horizontal plane and a vertical plane.

18. A method of controlling the flow of material through a moldboard assembly that includes the steps of attaching the bottom edge of a flexible moldboard sheet to a scraper blade so that the blade directs material moving thereover against the front of the sheet, supporting each top corner of the sheet in an adjustable arm, and independently positioning each adjusting arm to selectively contour the moldboard sheet to a desired shape.

19. The method of claim 18 that includes the further step of movably mounting the adjusting arms so that they can swing in both a vertical and horizontal plane.

20. The method of claim 19 that includes the further step of joining the distal ends of the adjusting arms with a spacer bar.

21. The method of claim 20 that includes the further step of slidably retaining the spacer bar in the top of the moldboard sheet.

* * * * *